United States Patent [19]

McKechnie et al.

[11] Patent Number: 4,564,330

[45] Date of Patent: Jan. 14, 1986

[54] SKIP FILLING APPARATUS AND METHOD

[76] Inventors: Ronald M. K. McKechnie, 9 8th Ave., Vaal Reefs, Transvaal; Renier P. Swart, 7 Henley Rd., Orkney, Transvaal, both of South Africa

[21] Appl. No.: 638,001

[22] Filed: Aug. 6, 1984

[30] Foreign Application Priority Data

Aug. 4, 1983 [ZA] South Africa ..... 83/5704

[51] Int. Cl.[4] ..... B66B 17/26

[52] U.S. Cl. ..... 414/612; 414/609; 414/786

[58] Field of Search ..... 414/592, 609, 610, 612, 414/613, 614, 615, 616, 328, 329, 786; 222/160; 141/181

[56] References Cited

U.S. PATENT DOCUMENTS 1,708,925 4/1929 Kendall ..... 414/615

2,737,308 3/1956 McMullen ..... 414/615

*Primary Examiner*—Robert G. Sheridan

[57] ABSTRACT

A material handling system in which a skip is filled with material from a loading flask. The skip moves downwardly during filling and the flask, which is supported by at least one ram, is caused to move downwardly in unison with the skip, to minimize material spillage.

9 Claims, 6 Drawing Figures

SKIP FILLING APPARATUS AND METHOD

BACKGROUND OF THE INVENTION

This invention relates generally to the handling of material and more particularly to the handling of material such as ore or rock in mines.

It is commonplace on mines to transfer ore or rock from an underground loading flask to a skip which is then hoisted to surface. In modern installations the transference of the material is effected substantially automatically.

The skip referred to is suspended from a cable in a shaft and the loading station may be a considerable distance below surface. In the loading process a rapid transference of material takes place and this may be likened to an impulse loading of the skip. As a consequence the skip is subjected to oscillations and eventually settles at a point which, depending on its final load, can be in the order of metres below the position at which loading commenced. The flask on the other hand is stationary and consequently a substantial gap can be formed between the mouth of the skip and the discharge end of the flask. Material destined for the skip may, in this way, not enter the mouth and instead fall down the shaft. This material is highly hazardous to personnel and any installation or equipment at a lower level.

To counteract the danger of falling material use has been made of a spillage bin immediately below the skip. It does happen however that the spillage bin can be filled with waste material in which event the skip may inadvertently be brought to rest on the top of this material. This can lead to a slack cable condition which in turn can result in cable failure.

Various approches to the problem are to be found in the disclosures in German Pat. Nos. 1215884, 718546, 876901 and 392005, and in U.S. Pat. Nos. 3,702,140, 1,708,925, 2,737,308 and 3,767,074.

The first mentioned specification describes an arrangement wherein an intermediate funnel, which moves together with the skip, is used to transfer material from a primary bunker to the skip. The primary bunker does not move. This arrangement, in practice, leads to considerable spillage of ore down the shaft and is not satisfactory.

SUMMARY OF THE INVENTION

It is an object of the present invention to provide a method of filling a skip which at least partly counters problems of the type described.

The invention provides a method of filling a skip with material from a loading flask which includes the steps of discharging material from the flask into the skip and causing or permitting the flask to move downwardly to a limited extent during at least part of the discharge.

The downward movement of the flask may be initiated on the opening of a discharge door of the flask or within a predetermined time interval of such opening.

The method of the invention may include the step of controlling the movement of the flask in a manner which is dependent on the movement of the skip.

The flask may be permitted to move in a predetermined manner. The nature of the movement of the flask may be determined at least partly by prior measurements taken of the skip movement during its filling. This data is then used to control the movement of the flask in subsequent filling operations.

Alternatively the skip movement may be tracked during each filling operation and the flask may be caused or permitted to move in a manner which is dependent on the tracked movement of the skip.

The flask movement may be controlled so that it is substantially asymptotic relatively to a reference location. The reference location may be substantially the lowermost position of the skip when it has come to rest after a filling operation.

The method of the invention may include the step, after the skip has been filled, or restoring the flask to its initial position i.e. to the position it had before its downward movement.

The method of the invention may include the step of supporting the flask on means which permits downward and upward movement of the flask. Such means may be actuated hydraulically or in any other suitable manner. In the former case the method may include the step of varying the rate of hydraulic fluid flow from or to the support means in a manner which is dependent on the movement of the skip.

During the filling operation the skip may oscillate. The oscillation may be substantially undamped or more generally be underdamped. Under these conditions the method of the invention may include the step of controlling the movement of the flask so that its position is not lower at any time relatively to the skip than an optimum filling position.

The method of the invention may also include the step of damping the movement of the skip. Preferably the skip oscillations are critically damped.

The invention further extends to a material handling installation which includes a loading flask, a skip which is movable by means of a hoist and which is filled with material from the flask, and means for causing or permitting movement of the flask in a downwards direction while the skip is being filled.

The said means may include at least one ram for supporting the flask. The ram may be hydraulically actuated. The ram may be movable to permit the flask to move downwardly, under its own mass, in a controlled manner while the skip is being filled.

The hydraulic fluid flow rate may be varied to control the rate of downward movement of the flask.

Use may be made of one or more control orifices or valves for regulating the hydraulic fluid flow rate. For example use may be made of one or more fixed or variable orifices or multiple independently operable valves for regulating the hydraulic fluid fluid flow.

In one form of the invention the said means may be designed to react in a predetermined manner. For example the control orifices or valves may be operated in such a way that the flask is caused or permitted to move along a predetermined path. This path may be determined from a plurality of measurements of the movement of the skip during prior filling operations.

In an alternative form of the invention use may be made of sensors for tracking the position of the skip and for controlling the movement of the flask accordingly.

Means may be provided for damping the oscillations of the skip during the filling operation. For example use may be made of a braking mechanism which permits the skip to descend at a controlled rate while it is being filled. This is equivalent to a critical damping situation. With this form of the invention, i.e. where there are no upward movements of the skip in the filling operation, the downward movement of the skip can be accurately tracked and the downward movement of the flask can be accurately varied so that the skip and the flask are maintained within predetermined limits of each other.

BRIEF DESCRIPTION OF THE DRAWINGS

The invention is further described by way of example with reference to the accompanying drawings in which.

DESCRIPTION OF PREFERRED EMBODIMENT

Figure 1:
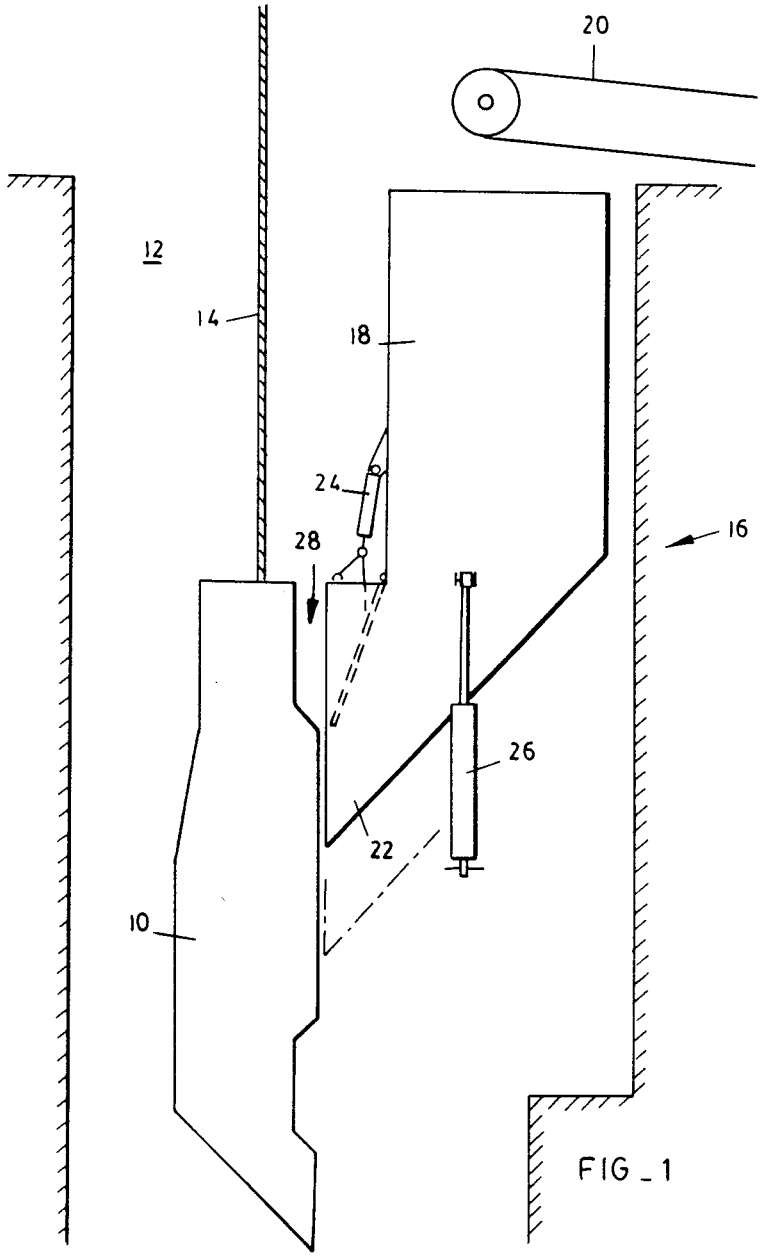
FIG. 1 is a simplified side view of a material handling installation according to the invention.

FIG. 1 illustrates a material handling installation according to the invention at an underground location. The installation includes a skip 10 which is movable vertically, upwardly and downwardly, in a shaft 12. The skip is suspended from a cable 14 which is movable by means of a hoist, not shown. When the skip is to be filled it is brought to a loading station 16 in the shaft; the loading station normally being located near or at the bottom of the shaft.

The loading station includes a loading flask 18 and one or more conveyors 20 for discharging material e.g. rock or ore into the flask 18. The flask includes a discharge chute 22 and a mechanism 24 for controlling the opening and closing of a door of the flask which leads onto the chute 22. The flask is supported by one or more vertically extending rams 26.

Figure 2:
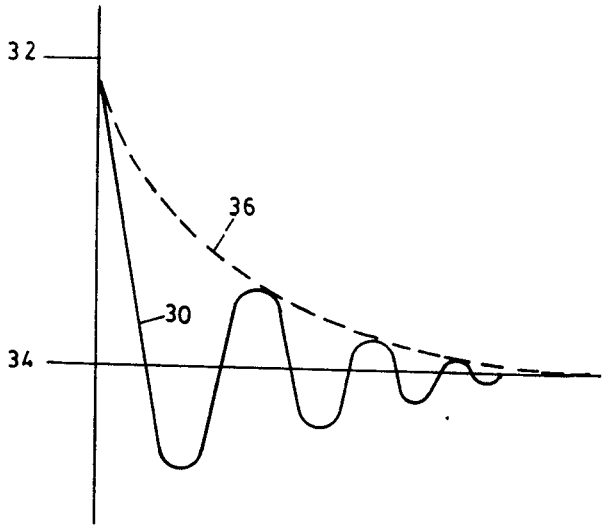
FIG. 2 is a curve which illustrates the movement of a skip of the installation of FIG. 1 while it is being filled, and FIGS. 3 to 6 respectively illustrate different control circuits used in the installation of the invention.

FIG. 2 is a graph which illustrates the movement of the skip 10 when it is filled with material from the flask 18. The filling operation is effected substantially automatically and is initiated in a known manner when a sensor on the flask detects that the skip 10 has been brought to a loading position relatively to the flask. At this position a mouth 28 at the upper end of the skip is substantially adjacent and opposing the chute 22. The sensor transmits a signal to a control device which causes the mechanism 24 to operate so that the door of the flask is opened. Material is then discharged under the action of gravity from the flask through the mouth 28 into the skip 10. The discharge takes place rapidly and is over within a period of about 2 seconds. After the discharge the door of the flask is closed by the mechanism 24.

The sudden inrush of material into the skip imparts a shock loading, or an impulse loading, to the skip. The cable 14 undergoes a degree of stretch and the skip oscillates whilst generally sinking lower in the shaft. This process is illustrated in FIG. 2 where a continuous line 30 represents the movement of the skip 10, during the filling operation, as it descends from its loading position designated by the numeral 32 to a rest position, designated by the numeral 34, at which the skip is fully loaded. The movement of the skip may thus, referring to the curve 30, be described as an underdamped oscillatory movement.

In this embodiment of the invention it is an objective to cause the flask 18 to be moved along a path shown in FIG. 2 by a dotted line and designated by the numeral 36. This path coincides with the peaks of the oscillatory skip movement and approaches the rest position 34 in a manner which can be described as being substantially asymtotic or, otherwise, as a critically damped movement. The point is that if the flask follows the path 36 the discharge chute 22 is never below the mouth 28 of the skip. On the other hand the distance between the chute and mouth is at all times kept to a practical minimum and spillage of material down the shaft is minimised as well.

The movement of the flask 18 during the skip filling operation is controlled by means of the ram 26. In general it may be said that as the flask discharges material into the skip hydraulic fluid is permitted to escape from the ram so that the flask settles downwardly in a predetermined manner under its own mass.

Various control circuits may be employed for regulating the movement of the ram 26. Examples of these circuits are illustrated in FIGS. 3 to 6.

Figure 3:
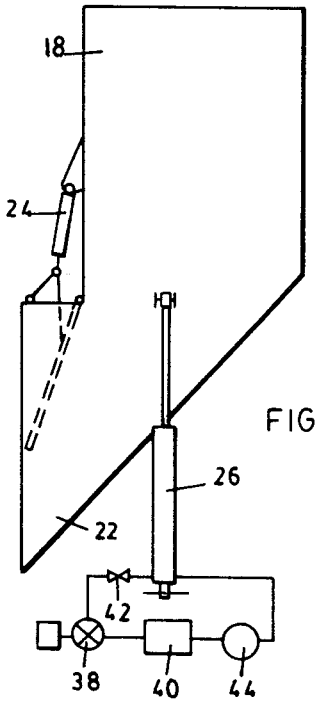
Figure 4:
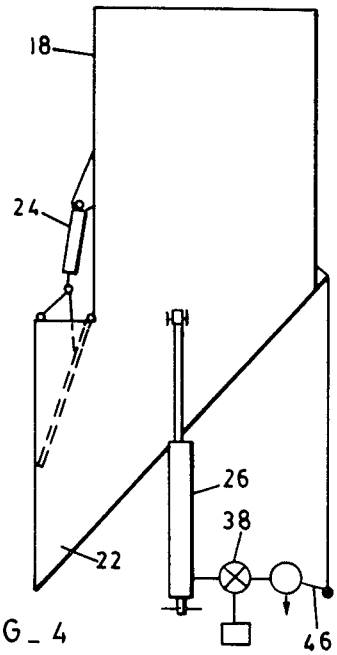

In the circuit of FIG. 3 a solenoid valve 38 is opened at the same time as material discharge from the flask is started. The valve 38 permits fluid from the ram 26 to flow to a receiving tank 40 through a fixed orifice 42. The size of the orifice is calculated to give a desired hydraulic fluid flow rate. During discharge of the flask the mass of the flask decreases and the pressure of the hydraulic fluid therefore also decreases. It may be seen from an examination of FIG. 2 that initially a high rate of flask movement is required and that the rate of movement decreases as the skip is filled. Since the fluid flow rate through the fixed orifice 42 is pressure dependent it will be possible under certain conditions to obtain flask movement which approximates the line 36 of FIG. 2. As pointed out in this way spillage of material is kept to a minimum. Once the ram 26 is fully settled, and this will normally take place as the skip is completely filled, the valve 38 is closed and a pump 44 is actuated to return fluid to the ram and extended so that the flask 18 is raised to its initial position.

In the circuit of FIG. 4 use is again made of a solenoid valve 38 which is opened when filling of the skip is started. In this case the fluid flows from the ram through an orifice the size of which is varied by means of a linkage mechanism 46 which is responsive to movement of the flask 18. When the valve 38 is opened the flask immediately starts descending but its rate of movement is determined, via the linkage, by the position of the flask relatively to its initial position. The fluid is returned to a tank and, after the skip has been filled, pumped back to the ram to restore the flask to its initial position.

Figure 5:
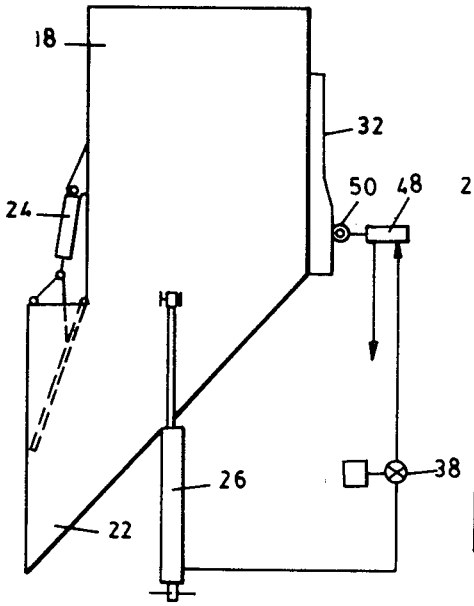

In the circuit of FIG. 5 the hydraulic fluid flows through a variable orifice or valve 48. The operation of the valve i.e. its opening and closing is determined by means of a cam follower 50 which rides on a cam 52 which is movable by means of the flask 18. Thus, as with the circuit of FIG. 4, the setting of the valve 48 is dependent on the position of the flask 18.

Figure 6:
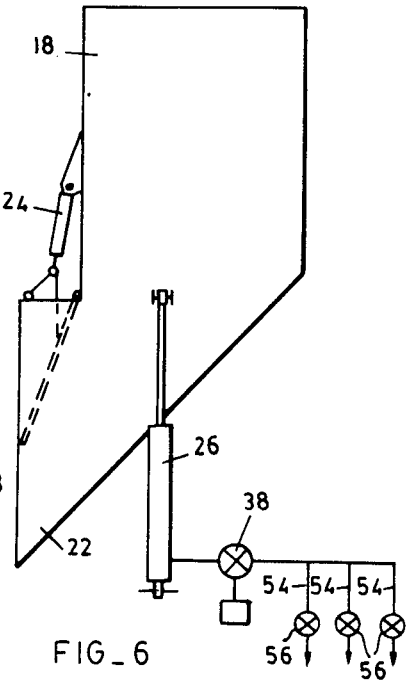

With the circuit of FIG. 6 fluid from the ram 26 is permitted to flow through a solenoid valve 38 and then through parallel paths designated 54 with each of the paths including a separate valve 56. The respective valves 56 are initially all opened but are closed separately at predetermined intervals after the valve 38 is opened. In this way the flow rate is varied and the flask movement is controlled so that it approximates the curve 36.

Other control techniques may of course be employed for determining the movement of the flask. For example the flask may be supported by electrically actuated means such as motors which drive gear trains. It is also possible to control the operation of the ram by means of sensors which are responsive to the position of the skip during its filling. The sensors determine the rate of movement of the skip and its position and generate a control signal which is used to open or close a valve so that the rate of hydraulic fluid flow from the ram 26 is controlled as desired.

In yet another form of the invention use is made of a brake mechanism on the skip which effectively dampens its oscillatory movement during the filling operation. The braking mechanism is installed on the shaft superstructure and is actuated at the same time as the door of the flask is opened. The braking mechanism permits the skip to move downwardly as it is loaded, at a controlled rate, and in this way minimizes oscillations of the skip. Thus there are no, or no substantial, upward movements of the skip. The flask can therefore track the downward movement of the skip far more accurately and the chute 22 and the mouth 28 can be maintained within a predetermined distance of one another with a greater degree of precision. This variation of the invention lends itself particularly to the use of sensors which track the position of the skip during each loading operation and which control the movement of the ram 26, or any other supporting device, accordingly.

We claim:

1. A method of filling a skip with material from a loading flask which includes the steps of supporting the flask on hydraulically actuable support means which permits vertical flask movement, discharging material from the flask into the skip, and causing or permitting the flask to move by varying the rate of hydraulic fluid flow from or to the support means in a manner which is dependent on the movement of the skip.

2. A method according to claim 1 which includes the step of controlling the movement of the flask in a manner which is dependent on the movement of the skip.

3. A method according to claim 2 wherein the movement of the flask is determined at least partly by prior measurements taken of the skip movement during its filling.

4. A method according to claim 2 which includes the steps of tracking the movement of the skip during each filling operation and of causing or permitting the flask to move in a manner which is dependent on the tracked movement of the skip.

5. A method according to any one of claims 1, 2, 3 and 4 which includes the step, when the skip undergoes oscillatory movement during flask discharge, causing the flask to move along a time dependent path which substantially passes through the upper peaks of the oscillatory skip movement.

6. A material handling installation which includes a loading flask, a skip which is movable by means of a hoist and which is filled with material from the flask, at least one hydraulically actuable ram which supports the flask, and means for controlling the rate of hydraulic fluid flow to or from the ram thereby to control the movement of the flask while the skip is being filled.

7. Apparatus according to claim 6 wherein the hydraulic fluid flow control means includes actuator means which is responsive to downward movement of the skip, and at least one orifice through which hydraulic fluid from the ram flows and which is responsive to the actuator means thereby to control the rate of hydraulic fluid flow from the ram.

8. Apparatus according to claim 6 wherein the hydraulic fluid flow control means includes a plurality of independently operably valves through which hydraulic fluid from the ram flows and which thereby control the rate of hydraulic fluid flow from the ram.

9. Apparatus according to any one of claims 6, 7 and 8 wherein the flask is caused to move along a path which maintains the skip and flask within predetermined limits of each other.

* * * * *